United States Patent [19]

Steel

[11] 4,387,895

[45] Jun. 14, 1983

[54] HAND RACKET

[76] Inventor: Charles F. Steel, 17202 Sandree Lee La., Huntington Beach, Calif. 92649

[21] Appl. No.: 305,495

[22] Filed: Sep. 25, 1981

[51] Int. Cl.[3] ..... A63B 59/00

[52] U.S. Cl. ..... 273/67 B; 273/73 D

[58] Field of Search ..... 273/64, 67 B, 67 DB, 273/73 D, 75, 166; 24/31 V

[56] References Cited

U.S. PATENT DOCUMENTS

| | | | |
|---|---|---|---|
| 1,477,460 | 12/1923 | Smith | 273/67 B |
| 1,523,899 | 1/1925 | Rittenhouse | 273/67 B |
| 2,228,586 | 1/1941 | Protzky | 273/67 B |
| 3,411,159 | 11/1968 | Berkhemer | 273/166 |
| 3,598,408 | 8/1971 | Klose | 273/166 |
| 3,912,267 | 10/1975 | Lyon | 273/73 D |

*Primary Examiner*—Richard C. Pinkham
*Assistant Examiner*—William H. Honaker
*Attorney, Agent, or Firm*—Knobbe, Martens

[57] ABSTRACT

A hand racket for use in the game of handball comprises a bowl-shaped base held in the palm of the hand, a racket face, and a strap for attaching the base to the hand. The strap is provided with self-adhering material in order to form adjustable finger and wrist loops, and is mounted on the base so as to permit the simple application of a racket to each hand. The base is also provided with a non-slip surface to prevent slippage.

8 Claims, 8 Drawing Figures

Fig. 1
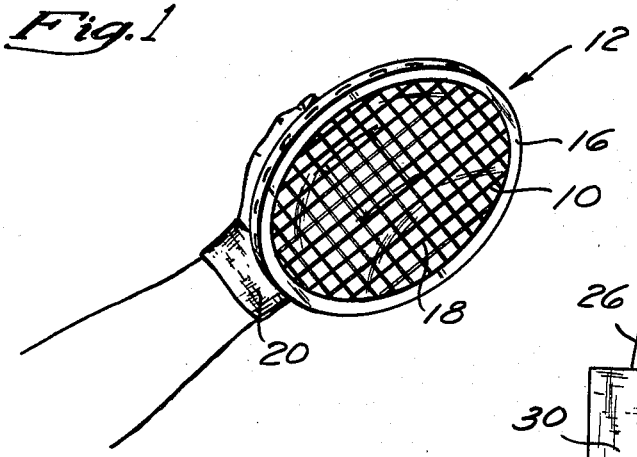
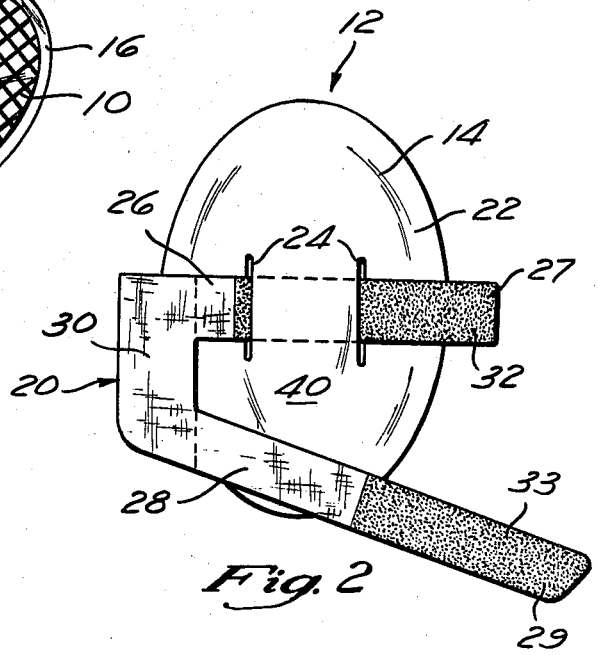
Fig. 2
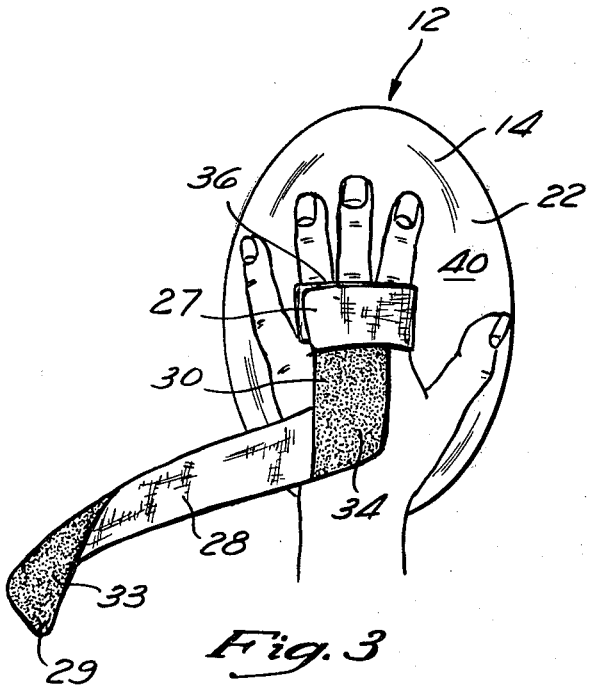
Fig. 3
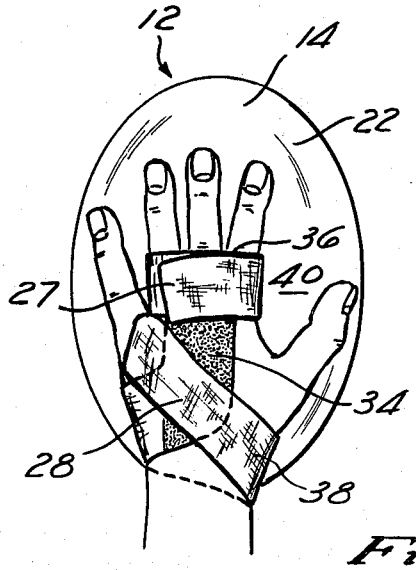
Fig. 4

HAND RACKET

BACKGROUND OF THE INVENTION

The game of handball is played on a court comprised of from one to four walls, although the game can be varied in any number of ways, e.g., it can be played across a tennis court, and with or without a ceiling. A fundamental aspect of the game of handball is that the players are completely free to use either hand to hit the ball, unlike raquetball or squash where a racket is held in one hand.

The game of handball has never attracted a relatively large following of players. This is due in large part to the fact that hitting the ball with the hand is often painful and injurious. Even experienced players with well-conditioned hands complain of swelling and pain lasting for days after playing this sport. Presently, gloves made of canvas or leather, with little or no padding, are used to protect the hands of the player. However, such gloves only slightly reduce the discomfort associated with the game.

It has been known to attach the hitting surface of a racket directly to the hand in order to protect the hand. However, the means of attachment employed by the prior art has typically been a glove, which makes the use of hand rackets for handball impractical. For example, U.S. Pat. No. 1,558,666 to J. Brewer et. al., discloses a hand racket which is attached to the hand of the player by means of a glove. Once the player inserts one hand into the glove and buckles it, the player's fingers are securely fastened to the racket making it impossible to buckle another racket onto the other hand.

SUMMARY OF THE INVENTION

The present invention fills the void in the prior art by providing a hand racket with a self-adhering strap which secures the racket onto the hand and wrist of the player, while at the same time giving the player the freedom of movement necessary to attach a second racket onto the other hand.

The racket of the present invention consists of a base or bowl, a rim, a racket face and a strap for securing the racket onto the player's hand. The strap is comprised of upper and lower portions, each of which has a self-adhering material securely attached to its rear surface, and a vertical portion which has a self-adhering material securely attached to the front surface. The upper and lower portions are utilized to bind the hand racket to the middle three fingers and the wrist, respectively, of the player's hand. This method of securing the racket to the hand is superior to the prior art in that it secures the hand and wrist of the player in a manner to prevent slippage while at the same time leaving the thumb and index finger free to attach a second racket on the other hand. Furthermore, the strap and self-adhereing material permit a wide range of adjustment.

Another important feature of the present invention is that the rear surface of the bowl, which engages the palm of the hand of the user, is provided with a non-slip material in order to improve the grip of the player on the hand racket. In addition, the configuration of the bowl itself is such that the player's hand is free to assume a comfortable yet secure grip. In addition, the rim of the bowl is provided with stringing tabs which facilitate the stringing of the hand racket.

DESCRIPTION OF THE DRAWINGS

FIG. 1 is a perspective view of the front of the hand racket of the present invention illustrating the manner in which it is applied to the hand of the user;

FIG. 2 is a rear view of the present hand racket illustrating the continuous, generally C-shaped strap which is utilized to secure the hand racket to the hand and wrist of the user;

FIGS. 3 and 4 are also rear views of the present hand racket illustrating the manner in which it is applied to the left hand and wrist of the user;

DETAILED DESCRIPTION OF THE INVENTION

Figure 8:
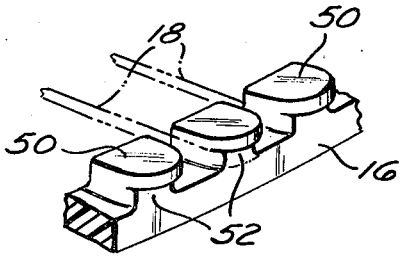
FIG. 8 is a partial perspective view of the rim of the present hand racket illustrating stringing tabs to facilitate the stringing of the racket.

FIG. 1 illustrates the front 10 of the hand racket 12 of the present invention as it is applied to the left hand. The racket comprises a base or bowl 14 (see FIG. 2) which engages the palm of the hand, a rim 16 surrounding the mouth or opening of the bowl, a string surface 18 or other resilient surface applied to the mouth of the bowl 14 for contacting the ball, and a strap 20 for securing the bowl 14 to the hand and wrist of the user. The strings 18 of the racket can be applied to the rim 16 of the bowl 14 in a conventional manner by threading them through holes therein. Alternatively, the strings 18 can be attached to the rim 16 by means of stringing tabs which are illustrated and explained in more detail in connection with FIG. 8.

The bowl 14 of the racket 12 is concave in shape so as to permit the strings 18 to flex backward upon impact with the ball, thus protecting the hand of the user and accelerating the ball. The configuration of the bowl 14 is shown in the longitudinal and transverse cross-sections of FIGS. 6 and 7, respectively, and explained in more detail below.

Figure 7:
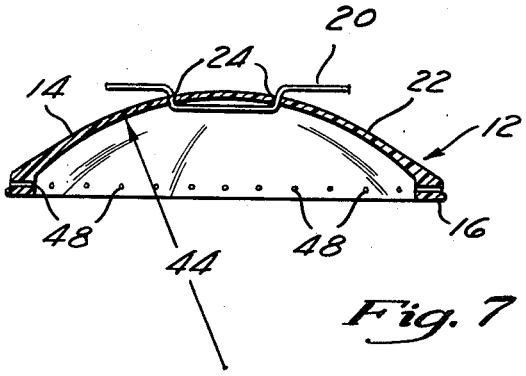
FIG. 7 is a transverse cross-section of the bowl.

FIG. 2 illustrates the rear 22 of the racket 12, which in this case is intended for application to the left hand. However, a right handed racket is identical to that shown in FIG. 2, with the exception that the strap 20 will appear as a mirror image. The bowl 14 of the racket is preferably constructed from a rigid material to provide strength and durability to the racket. Preferably, the bowl 14 is injection molded froma nylon material reinforced with fiber glass for strength and durability. The surface of the bowl is provided with a pair of parallel slits 24, as shown in FIG. 2 which are utilized to secure the generally c-shaped strap 20 to the bowl 14. This strap 20 is comprised of an upper horizontal portion 26, a vertical portion 30, and a lower obtuse portion 28. The upper portion 26 is threaded through the slits 24 as shown in FIGS. 2 and 7 to provide the only attachment of the strap 20 to the bowl 14. If the strap 20 should become worn, it can be easily replaced.

The right ends 27 and 29 of the upper and lower portions 26 and 28, respectively, of the strap 20 are provided on their rear surfaces (which are visible in FIG. 2) with an adhesive material 32 and 33, respectively, preferably a self-adhering material, such as a "hook and loop" type self-adhering material. Preferably, Velcro (a registered trademark) is utilized. Although not shown in FIG. 2, the entire front surface of the vertical portion 30 of the strap 20 is also provided with such an adhesive material. It should also be noted that the slits 24 of the bowl 14 are longer than the width of the upper portion 26 of the strap 20, thereby permitting vertical adjustment in the position of the strap 20 with respect to the bowl 14.

FIG. 3 illustrates the manner in which the upper portion 26 of the strap 20 is utilized to attach the racket 12 to the middle three fingers or distal portion of the user's hand. First, the palm of the left hand is placed on the rear surface 22 of the bowl 14 approximately in the position shown. Using the free hand, the left end of the upper portion 26 and the vertical portion 30 are folded to the right over the middle three fingers of the hand, thus exposing the adhesive material 34 on the front surface of the vertical portion 30. It should be noted that, at this point, the front surfaces of the vertical and lower portions 30 and 28, respectively, and now facing toward the rear, and the lower portion 28 extends toward the left, rather than toward the right as in FIG. 2. Next, the right end 27 of the upper portion 28 is folded to the left over the middle three fingers, with the adhesive material 32 on the upper portion 26 being securely attached to the now exposed adhesive material 34 on the front surface of the vertical portion 30, thus forming a finger loop 36 for the middle three fingers of the hand.

Once this finger loop 36 is formed, there is generally no need to readjust it unless the racket 12 is used by another player. That is, the middle three fingers can simply be slid into and out of this loop 36 for quick and easy attachment of the racket 12. The left hand can now be removed from the loop 36 and the same adjustment made in connection with the right hand racket in order to form a finger loop for the middle three fingers of the right hand.

FIGS. 3 and 4 illustrate the manner in which attachment of the racket 12 to the left hand is completed. As shown in FIG. 3, the front surface bearing the adhesive material 34 of the vertical portion 30 of the strap 20 extends down the middle of the hand and wrist to provide an anchor for the wrist loop 38, which is shown in FIG. 4. This anchor, which is attached to the bowl 14 by means of the finger loop 36, permits the lower portion 28 to be applied to the wrist under substantially constant tension, thereby reducing the amount of dexterity required to apply a racket on the opposite hand as described below. The distal or right end 29 of the lower portion 28 is wrapped around the outside of the wrist and brought into the inside of the wrist where the adhesive material 29 on the rear surface of the lower portion 28 is securely attached to the adhesive material 34 on the front surface of the vertical portion 30, as shown in FIG. 4. Thus, this outside wrap of the lower portion 28 forms a wrist loop 38 which completes the attachment of the racket 12 to the proximal or wrist portion of the hand. The loop 38 can be wrapped as tightly as the user desires, and is widely adjustable because of the substantial amount of the adhesive material 29, both on the vertical portion 30 and the distal end 29 of the lower portion 28. This outside wrap is preferred since it is a slightly easier wrapping motion; however, any other wrapping motion is also suitable.

As shown in FIG. 4, the thumb and small finger of the hand are free to grip the bowl 14 in any comfortable position. In addition, the rear surface 22 of the bowl is provided with a non-slip material 40 in order to increase the security of the engagement between the racket 12 and the hand. This is an especially important feature since the perspiration of the hand could tend to cause slippage. Preferably, this non-slip material is that sold by Supreme Grip of New York, although any other suitable material can be used. Furthermore, as shown in FIG. 5, the thumb is free to grip, in combination with the index finger, the lower portion **28*a* of the strap 20*a* of the right hand racket 12*a*** in order to apply it to the right hand.

Figure 5:
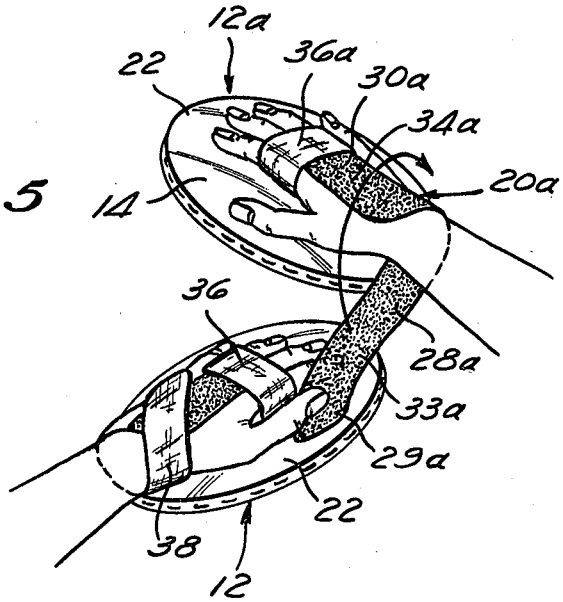
FIG. 5 is a perspective view illustrating the manner in which the present hand racket can be applied to the opposite hand after it has been applied to one hand.

FIG. 5 illustrates the manner in which the opposite racket is applied to the free hand. As explained above, the finger loop **36*a* is previously formed so that the middle fingers of the free hand are simply slid into and out of it. Next, the lower portion 28*a* of the strap 20*a* is gripped between the thumb and the index finger of the left hand as shown in FIG. 5, and wrapped around the outside of the wrist (as indicated by the arrow) and secured to the vertical portion 30*a* of the strap 20*a*, in the manner as described above and shown in FIGS. 3 and 4. Thus, the adhesive material 33*a* on the distal end 29*a* of the lower portion 28*a* is attached to the material 34*a* on the front surface of the vertical portion 30*a***.

In order to remove the racket **12*a*, the process is simply reversed by utilizing the thumb and index finger of one hand to disengage the lower portion 28 and vertical portion 30 of the wrist loop 38 of the opposite hand so that it can be removed from the finger loop 36. Thus, both rackets 12 and 12*a*** can be quickly and easily engaged and disengaged from the hand of the user.

Figure 6:
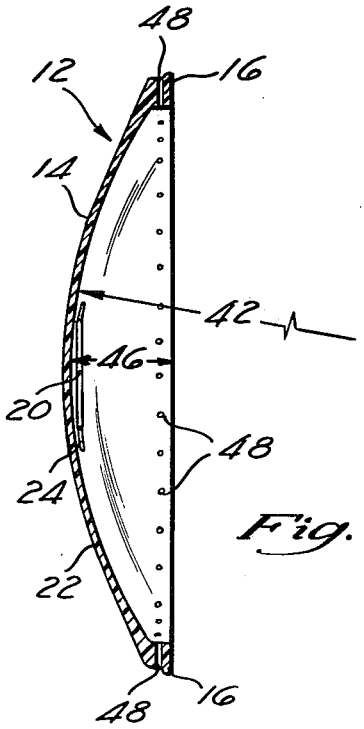
FIG. 6 is a longitudinal cross-section of the bowl of the present hand racket.

FIGS. 6 and 7 illustrate the preferred configuration of the bowl 14 of the present hand racket 12. This particular configuration has been selected because of the comfort it affords for the average adult hand; however, other shapes can be easily devised for younger adults and children. Preferably, each hand racket 12 is about nine inches long and seven inches wide. The longitudinal radius 42 of the curvature of the bowl 14, as shown in FIG. 6 is about 7½ inches, while the transverse radius 44 of curvature, shown in FIG. 7, is about four inches. The maximum depth 46 of the bowl is about 1½ inches, as shown in FIG. 6. The rim 16 of the bowl is provided with holes 48 for stringing the racket 12 in a conventional manner. Alternatively, stringing tabs 50 on the rim 16 illustrated in FIG. 8 can be used to more quickly, easily string the racket. The use of these tabs 50 is possible because only one surface of the racket contacts the ball. Thus, the tabs 50 are formed by essentially cutting notches out of the rim 16 of the bowl 14 in order to provide passageways for the string 18. The tabs 50 are undercut as indicated at 52, in order to prevent slippage of the strings 18.

What is claimed is:

1. A hand racket, adapted to be secured to the hand, comprising:

a semi-spherical base for engagement with the palm of the hand, the rim of said base forming a mouth;

a racket face attached to said base and covering said mouth for resilient contact with a ball; and a strap attached to said base for securing said racket to said hand, one portion of said strap securing the racket to the distal portion of the hand while leaving the thumb and small finger free to grip said base, and another portion securing the racket to the proximal portion of the hand, one end of said strap forming a loop for securing said racket to the fingers and the opposite end of said strap forming a loop surrounding the wrist, said ends of said strap being adjustably attachable to themselves in order to provide an adjustment of the size of said loops.

2. The hand racket of claim 1 wherein said ends of said strap are attached to themselves by a means of self-adhesive material applied to the surfaces of said strap.

3. The hand racket of claim 1 wherein said strap is generally C-shaped.

4. The hand racket of claim 1 wherein said base is provided with a non-slip material in order to provide a secure engagement between said base and said palm of the hand.

5. A hand racket adapted to be easily secured to the hand even when a similar racket is secured to the opposite hand, comprising:

a concave base for engagement with the palm of the hand, the rear surface of said base being provided with a non-slip material and the rim of said base forming a mouth;

a racket face attached to said base and covering said mouth for resilient contact with a ball; and a strap attached to said base for securing said racket to the hand, said strap comprising:

a generally horizontal upper portion including means for securing the racket to the middle fingers of the hand while leaving the thumb and small finger free to grip said base;

a generally horizontal lower portion including means for adjustably securing the racket to the base of the hand or wrist; and a generally vertical portion interconnecting said upper and lower portions of said strap and including means for adjustably anchoring said lower portion to said base.

6. The hand racket of claim 5 wherein seld-adhering material is applied to said upper and lower portions to provide means for forming finger and wrist loops, respectively.

7. The hand racket of claim 5 wherein said rim of said base is provided with stringing tabs, each said tab having an overhanging portion.

8. A hand racket adapted to be easily secured to the hand even when a similar racket is secured to the opposite hand, comprising:

a concave base for engagement with the palm of the hand, the rear surface of said base being provided with a non-slip material and the rim of said base forming a mouth;

a racket face attached to said base and covering said mouth for resilient contact with a ball; and a strap attached to said base for securing said racket to the hand, said strap comprising:

a first portion including means for securing the racket to the middle fingers of the hand while leaving the thumb and small finger free to grip said base;

a second portion including means for adjustably securing the racket to the base of the hand or wrist; and a third portion interconnecting said first and second portions of said strap and including means for adjustably achoring said second portion to said base.

* * * * *